United States Patent [19]

Porter

[11] Patent Number: 4,970,833

[45] Date of Patent: Nov. 20, 1990

[54] ARCHED TUBULAR FRAME BUILDING CONSTRUCTION

[76] Inventor: William H. Porter, P.O. Box 249, Saugatuck, Mich. 49453

[21] Appl. No.: 360,985

[22] Filed: Jun. 2, 1989

[51] Int. Cl.[5] ..... E04B 7/02

[52] U.S. Cl. ..... 52/93; 52/641; 403/171

[58] Field of Search ..... 52/90–93, 52/639, 641, 726; 29/155 R; 403/171

[56] References Cited

U.S. PATENT DOCUMENTS

| | | | |
|---|---|---|---|
| 2,270,161 | 1/1942 | Briggs | 52/90 |
| 2,461,916 | 2/1949 | Omar | 52/93 |
| 2,678,488 | 5/1954 | Erzer | 29/155 R |
| 3,177,618 | 4/1965 | Jacob | 52/90 |
| 3,308,596 | 3/1967 | Cooper et al. | 52/630 |
| 3,462,895 | 8/1969 | Wormser | 52/93 |
| 3,562,975 | 2/1971 | Moss | 52/80 |
| 3,974,602 | 8/1976 | Pohl et al. | 52/93 |
| 4,011,697 | 3/1977 | Fedolfi | 52/90 |
| 4,078,341 | 3/1978 | Peterson et al. | 52/90 |
| 4,125,973 | 11/1978 | Lendrihas | 52/91 |
| 4,187,651 | 2/1980 | Tolsma | 52/93 |
| 4,271,654 | 6/1981 | Jungbluth | 52/637 |
| 4,347,690 | 9/1982 | Wallace, Jr. | 52/93 |
| 4,575,974 | 3/1986 | Porter | 52/86 |
| 4,630,550 | 12/1986 | Weitzman | 403/171 |

FOREIGN PATENT DOCUMENTS

| | | | |
|---|---|---|---|
| 471236 | 7/1914 | France | 52/641 |
| 418613 | 2/1967 | Switzerland . | |
| 126492 | 5/1919 | United Kingdom . | |
| 142128 | 4/1921 | United Kingdom . | |
| 2174430 | 11/1986 | United Kingdom | 52/726 |

OTHER PUBLICATIONS

Publication of Cover-All, division of W. H. Porter, Inc., 4240 N. 136th Avenue, Holland, Mich. 49423, entitled "Pre-Engineered Carports and Shelters", copyright, Dec. 1983.

*Primary Examiner*—James L. Ridgill, Jr.
*Attorney, Agent, or Firm*—Emrich and Dithmar

[57] ABSTRACT

An arched tubular frame for building construction includes a plurality of box beams comprised of double edge abutting, welded C-beams coupled together by internal nut/bolt combinations which are hidden from view and not exposed to the elements. The lower end of each vertical column is adapted for secure coupling to an anchor bolt extending upward from the building's base, or foundation, and permits an arched rectangular frame of modular construction to be pivotally raised to a generally vertical orientation and secured to the building's base. Sandwich-type foam core roof panels may be secured to an upper portion of the tubular frame.

9 Claims, 2 Drawing Sheets

ARCHED TUBULAR FRAME BUILDING CONSTRUCTION

BACKGROUND OF THE INVENTION

This invention relates generally to building construction and is particularly directed to a tubular frame building support structure.

Building support structures are generally comprised of either concrete, wood or steel. Arched structures of this type generally include vertical columns, eave and ridge beams, and trusses. The structural members are either in the form of I-beams or C-beams which are open along one side thereof. I-beams employed in such structures are generally coupled together by nut and bolt combinations which extend outward from the beams and must generally be hidden from sight if aesthetics and environmental exposure are considerations. C-beams are generally weaker in strength than I-beams and thus offer limited span distances and frequently require supplemental reinforcement. Neither of these types of structural members is amenable to pre-assembly of structural components and thus generally requires that each structural member must be added to the already assembled members as the building is constructed on-site. For any but the smallest of buildings, this generally involves the use of a crane for lifting structural members into place for coupling to the support frame as it is assembled. The positioning and mounting of the structure's support members on an individual basis also adds to building construction complexity and cost.

The present invention avoids the aforementioned limitations of prior art building construction by providing an arched rectangular tube frame building construction which can be easily assembled by hand; makes use of hidden connections between frame structural members to provide a neat, clean appearance; is lightweight yet of high strength; and is adapted for modular construction in that major subassemblies may be pre-assembled prior to actual on-site construction.

OBJECTS AND SUMMARY OF THE INVENTION

Accordingly, it is an object of the present invention to provide an improved tubular support structure for a building.

It is another object of the present invention to provide a high strength, lightweight tubular frame building construction which is easily assembled and securely joined together by hidden connections.

A further object of the present invention is to provide a bolted together arched frame for a building which allows the frame to be tilted upward into position and attached to a base, or foundation.

Yet another object of the present invention is to provide a rectangular arched frame of modular construction which employs support columns of heavy welded tubular stock and truss, eave and ridge beams comprised of light gauge, edge-to-edge, welded together C-sections forming a box beam.

A still further object of the present invention is to facilitate assembly of an arched rectangular building support frame of modular construction by employing a vertical tubular member for joining the frame's ridge beam to a pair of trusses for completing the truss at midpoint.

This invention contemplates a tubular frame for a building construction positioned on a base and including an arched support arrangement, the tubular frame comprising: a plurality of rectangular tubular members including support columns, eave and ridge beams, and trusses, wherein each of the beams and trusses is comprised of a pair of edge-to-edge coupled, elongated, generally linear C-beams; internal connections disposed within each of the tubular members for securely coupling together adjacent ones of the tubular members; and mounting means for attaching the arched support arrangement to the base by tilting the arched support arrangement to a generally vertical orientation and affixing the arched support arrangement to the base.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1:
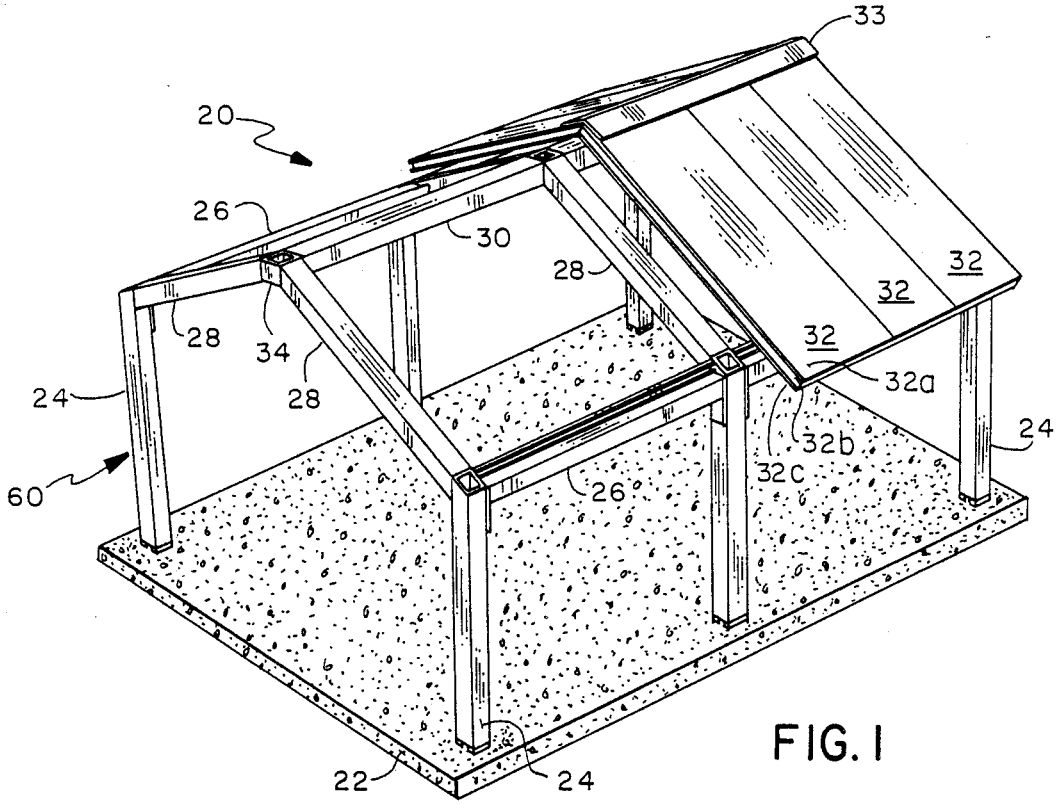
FIG. 1 is an upper perspective view of an arched tubular frame building construction positioned upon a base, or foundation, in accordance with the principles of the present invention.

Referring to FIG. 1, there is shown an upper perspective view of a tubular building frame 20 in accordance with the present invention positioned upon a base, or foundation, 22. The base 22 is shown as a generally flat, rectangular slab of concrete, but may be in the form of any of the conventional support structures such as a foundation wall or a plurality of spaced footings.

The tubular building frame 20 is comprised of a plurality of tubular structural members each having a generally rectangular cross section and comprised of a high strength material such as steel. The tubular structural members include a plurality of generally vertically oriented support columns 24, generally horizontally oriented eave and ridge beams 26 and 30, and trusses 28.

Each support column 24 is mounted to the base 22 at its lower end and is coupled to the end of a truss 28 and to at least one eave beam 26. Each of the trusses 28 is coupled at its lower end to a support column 24 and at its upper end to a ridge beam 30. The combination of a pair of support columns 24 and pair of trusses 28 form a modular arched vertical support frame 60 which may be pre-assembled and placed in position as described below.

Disposed on the upper portion of the tubular building frame 20 in an edge-abutting manner are a plurality of roof panels 32. Each of the roof panels 32 is of sandwich-type construction having a central layer, or core, **32*b* of a rigid insulating material such as plastic foam and upper and lower outer surfaces 32*a*, 32*c* of a weather resistant, high strength material such as aluminum or steel sheet metal or a high strength, hard plastic material. An inverted V-shaped roof cap 33 is positioned along the abutting upper edges of adjacent roof panels 32 disposed upon and supported by the tubular building frame 20. Each roof panel 32 is typically attached to an eave beam 26, a truss 28, and a ridge beam 30** by conventional means such as self-tapping steel screws which are not shown for simplicity.

Figure 2:
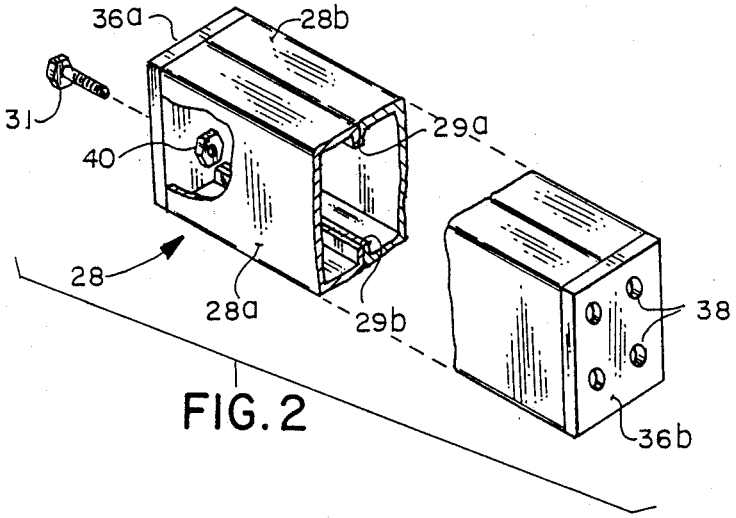
FIG. 2 is a partial cutaway perspective view of a truss used in the tubular frame building construction shown in FIG. 1.

Referring to FIG. 2, there is shown a partially cutaway perspective view of a truss 28 used in an upper portion of the tubular frame building construction 20 of the present invention. The truss 28 is comprised of a pair of C-section beams **28*a* and 28*b* aligned in edge abutting contact so as to form a closed beam having a generally rectangular cross section. The two C-section beams 28*a*, 28*b* are coupled together along the respective lengths thereof by a pair of weldments 29*a* and 29*b*. First and second end plates 36*a*, 36*b*are securely attached such as by weldments to respective ends of the truss 28. Each of the end plates 36*a*, 36*b* includes a plurality of apertures 38 therein. Disposed on the inner surface of an end plate and aligned with each of the aforementioned end plate apertures 38 is an inner nut 40 which is adapted for engaging a threaded mounting pin, such as a bolt 31 during coupling of the truss to another structural member of the tubular building frame 20**.

Figure 3:
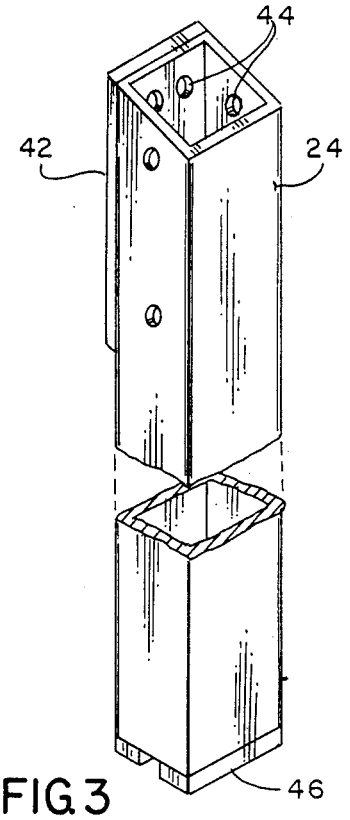
FIG. 3 is a partial perspective view of a vertical support column used in the tubular frame building construction shown in FIG. 1.

Referring to FIG. 3, there is shown a partial perspective view of a vertical support column 24. The support column 24 is in the form of a unitary box beam which is open at its upper end and has a base attachment 46 at its lower end. The upper end of the support beam 24 is provided with a plurality of apertures 44 for attachment to at least one eave beam 26 as well as to a truss 28. A mounting plate 42 also having apertures therein aligned with the apertures 44 in the upper end of the support column 24 facilitates attachment of the support beam 24 to a truss 28 and strengthens the coupling therebetween. Details of the base attachment 26 on the lower end of the support column 24 are provided below.

Figure 4:
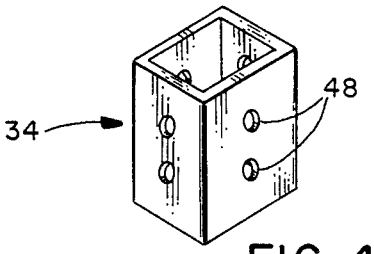
FIG 4 a perspective view of a connector tube used for coupling a ridge beam to a pair of trusses in the tubular frame building construction shown in FIG. 1.

Referring to FIG. 4, there is shown an generally rectangular connector tube 34 having open upper and lower portions for coupling ends of adjacent trusses 28 in forming the arch portion of the vertical support frame 60 of the tubular building frame 20. Lateral portions of the connector tube 34 are provided with a plurality of spaced apertures 48 to facilitate attachment of the connector tube to respective ends of trusses 28 and ridge beams 30 in forming the arch portion of the vertical support frame 60.

Figure 5:
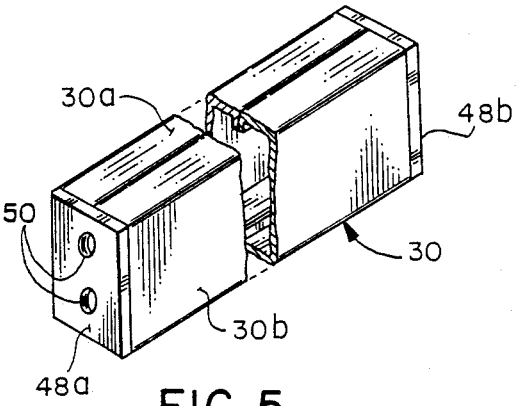
FIG. 5 is a partial perspective view of a ridge beam used in the tubular frame building construction shown in FIG. 1.

Referring to FIG. 5, there is shown a partial perspective view of a ridge beam 30 for use in the tubular building frame 20. Securely attached to respective ends of the ridge beam 30 such as by weldments are a pair of end plates **48*a* and 48*b*. Each of the end plates 48*a*, 48*b* is provided with a plurality of spaced apertures 50, to facilitate secure coupling of the ridge beam 30 to a pair of connector tubes 34 at respective ends thereof. As in the case of the truss 28 previously described, the ridge beam 30 is also comprised of a pair of C-section beams 30*a*, 30*b*** coupled together along respective abutting edges thereof by conventional means such as weldments.

Figure 6:
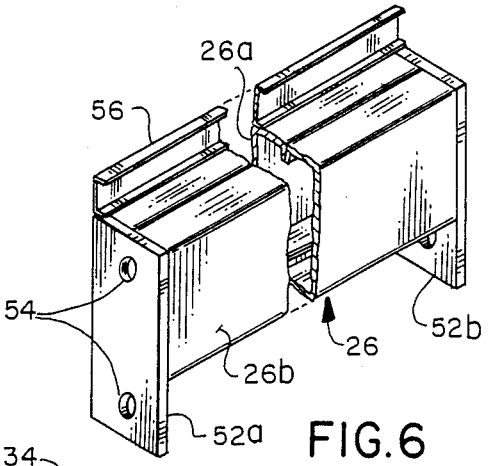
FIG. 6 is a partial perspective view of an eave beam used in the tubular frame building construction shown in FIG. 1.

Referring to FIG. 6, there is shown a partial perspective view of an eave beam 26 for use in the tubular building frame 20 shown in FIG. 1. The eave beam 26 is also generally rectangular in cross section and is comprised of a pair of C-section beams **26*a* and 26*b* welded together along abutting edges thereof. First and second end plates 52*a*, 52*b* are securely attached to respective ends of the eave beam 26 to facilitate attachment of the eave beam to a pair of support columns 24. Each of the end plates 52*a* and 52*b* is provided with a plurality of spaced apertures 54 for secure attachment of the eave beam 26 to a support column 24 by conventional nut and bolt combinations. Extending from an upper portion of the eave beam 26 is a roof support extension 56. The roof support extension 56 extends above the upper portion of the eave beam 26 and engages and provides support for the roof panels 32. The roof support extension 56 also provides a visual closure between each roof panel 32 and eave beam 26**.

Figure 7:
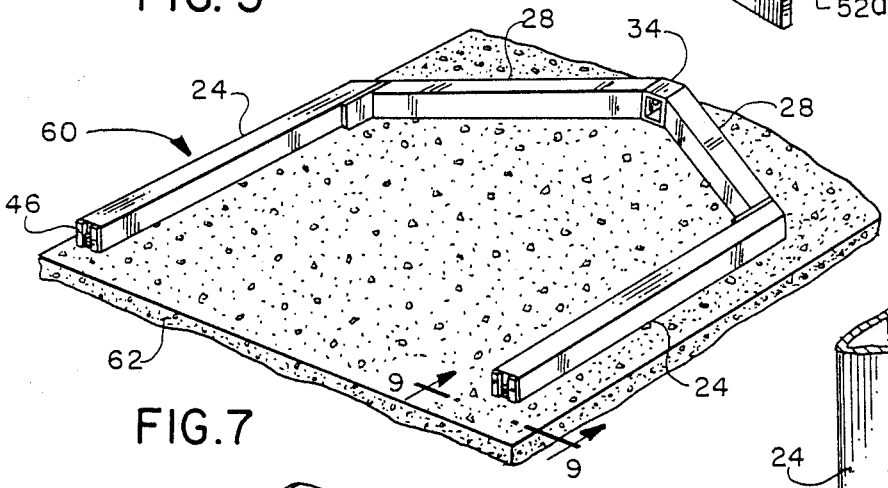
FIGS. 7 and 8 illustrate the manner in which a modular arched vertical support frame is placed in position for mounting to a base as well as for attachment to other tubular frame members.
Figure 10:
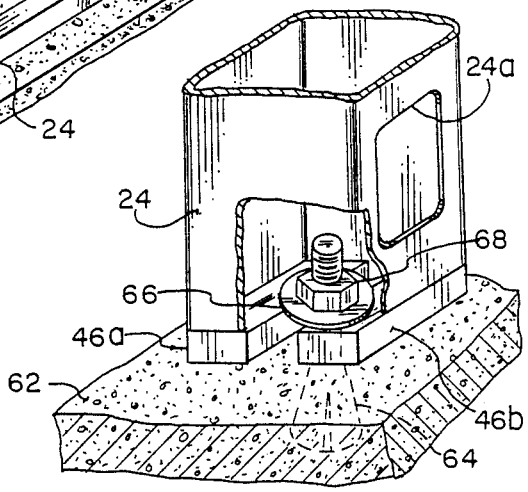
FIGS. 9 and 10 illustrate details of the manner in which the modular vertical support frame is securely attached to the building's base after being tilted upward to a generally vertical orientation on the base as shown in FIGS. 7 and 8.
Figure 9:
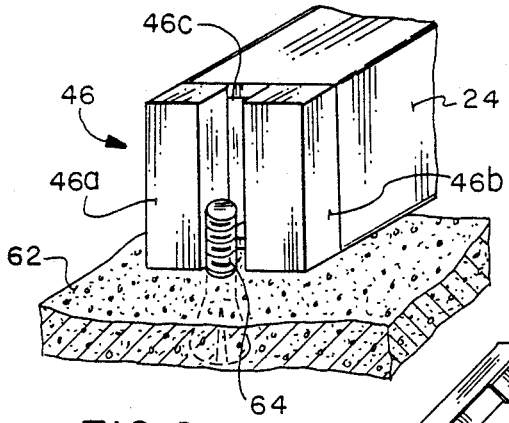
Figure 8:
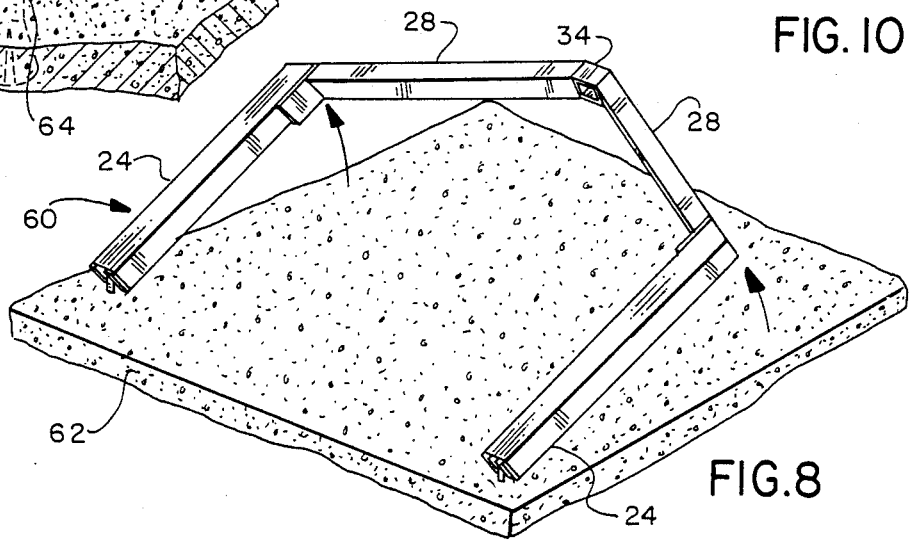

Referring to FIGS. 7 and 8, there is shown the manner in which a vertical support frame 60 comprised of a pair of support columns 24 and trusses 28 is moved into position and attached to the base, or foundation, 62. FIGS. 9 and 10 show details of the support frame mounting arrangement on the lower ends of each of the support columns 24. As shown in FIGS. 7 and 9, the vertical support frame 60 is initially positioned upon the base 62 as a module, or in an assembled configuration. Respective ends of the support columns 24 on which are positioned base attachments 46 are positioned adjacent to a respective mounting pin, or expansion bolt, 64 positioned in and extending from the base 62. The base attachment 46 on the lower end of each of the support columns 24 includes a pair of spaced mounting plates **46*a* and 46*b* having a mounting slot 46*c* therebetween. The mounting plates 46*a*, 46*b* are affixed to the lower end of a support column 24 by conventional means such as weldments. The mounting pin 64 is positioned within the mounting slot 46*c* as shown in FIG. 9. The vertical support frame 60 is then pivotally displaced about the mounting pins 64 positioned adjacent to its respective base attachments 46 so as to assume a generally vertical orientation relative to the base 62 as shown in FIG. 10. An access aperture 24*a* is provided within the lower end of each of the support columns 24 to permit the combination of a washer ring 66 and a nut 68 to be positioned over and to engage the mounting pin 64. With the nut 68 securely tightened on the mounting pin 64, the washer 66 is disposed in secure, abutting contact with the mounting plates 46*a* and 46*b* to securely maintain the support column 24 as well as the vertical support frame 60 in a generally vertical orientation upon the base 62**.

There has thus been shown an arched tubular frame building construction comprised of a plurality of elongated, linear, tubular support members each having a generally rectangular cross section. The upper support members, such as ridge and eave beams and trusses, are comprised of double edge-abutting, welded C-beams for reduced weight and high strength, while the support columns are in the form of unitary box beams. Each of the support members is coupled to one or more other support members by conventional nut and bolt combinations which are positioned within the support beams and thus hidden from view and shielded from the environment. A unique mounting arrangement permits an arched modular vertical support frame to be tilted upward from a generally horizontal to a generally vertical orientation and securely coupled to a base, or foundation. The upper portion of the tubular frame building construction is adapted to receive and support a plurality of sandwich-type, foam core roof panels in a gabled arrangement.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A tubular frame for building construction positioned on a base and including an arched support arrangement, said tubular frame comprising:

a plurality of rectangular tubular members including support columns, eave and ridge beams, and trusses, wherein each of said beams and trusses is comprised of a pair of edge-to-edge coupled, elongated, generally linear C-beams;

internal connections disposed within each of said tubular members for securely coupling together adjacent ones of said tubular members; and mounting means for attaching the arched support arrangement to the base of tilting the arched support arrangement to a generally vertical orientation and affixing the arched support arrangement to the base, wherein said mounting means includes a pair of mounting plates attached to a lower end of a support column in a spaced manner, expansion bolt means extending from the base and adapted for insertion between said mounting plates, and nut means for attachment to said expansion bolt means and engagement with said mounting plates, and wherein said nut means and said expansion belt means are disposed within the support column and thus hidden from view, with each of said support columns including an aperture therein for providing access to said nut means when attaching the arched support arrangement to the base.

2. A tubular frame in accordance with claim 1 wherein each pair of C-beams are coupled by a pair of weldments extending substantially the entire lengths thereof.

3. A tubular frame in accordance with claim 1 wherein said mounting means are attached to a lower end portion of each of said support columns.

4. A tubular frame in accordance with claim 1 wherein each of said tubular members includes a plate on each end thereof and wherein each plate has a plurality of apertures therein, said internal connections including a plurality of nut and bolt combinations, wherein each nut is affixed to an inner surface of an end plate in alignment with an aperture therein and is adapted to receive and engage a bolt inserted through an adjacent aperture.

5. A tubular frame in accordance with claim 1 further comprising tubular means coupling adjacent ends of said trusses and said ridge beams.

6. A tubular frame in accordance with claim 5 wherein said tubular means includes a generally rectangular connector tube having a plurality of apertures therein and wherein said internal connections include a plurality of threaded coupling pins each inserted through a respective aperture.

7. A tubular frame in accordance with claim 1 further comprising a plurality of generally rectangular, flat panels positioned upon and supported by said eave and ridge beams and said trusses.

8. A tubular frame in accordance with claim 7 wherein each of said panels is of a sandwich-type and includes upper and lower layers and a foam plastic core disposed therebetween.

9. For use in building construction positioned on a base, an arched support frame comprising:

a plurality of elongated, generally linear tubular structural members including generally vertically oriented support columns;

internal connecting means disposed within each of said structural members adjacent to each respective end thereof for securely coupling adjacent structural members in forming said arched support frame; and mounting/attachment means coupled to and disposed within a lower end of each of said support columns for allowing the support frame to be pivotally displaced from a generally horizontal orientation to a generally vertical orientation on the base and for securely affixing said arched support frame to the base, wherein said mounting/attachment means includes, in combination, expansion bolt means extending from the base, mounting slot means in the lower end of each of said support columns for receiving said expansion bolt means and allowing said support frame to be tilted upward from a generally horizontal orientation to a generally vertical orientation on the base with said expansion bolt means disposed within said mounting slot means during installation of the support frame, and nut means for attachment to said expansion bolt means and engagement with said mounting slot means for securely maintaining said support column in position on the base, wherein said expansion bolt means and said nut means are disposed within said support column and thus hidden from view and wherein each of said support columns includes an aperture for providing access to said mounting/attachment means when said support column is affixed to the base in a generally vertical orientation.

* * * * *